US005831641A

United States Patent [19]

Carlson

[11] Patent Number: 5,831,641

[45] Date of Patent: Nov. 3, 1998

[54] METHODS AND APPARATUS FOR IMPRINTING INDECIA ON A THREE DIMENSIONAL ARTICLE

[75] Inventor: Richard G Carlson, Arcadia, Calif.

[73] Assignee: Eugene Gollings, Los Angeles, Calif.

[21] Appl. No.: 758,225

[22] Filed: Nov. 27, 1996

[51] Int. Cl.[6] ..... B41J 3/00

[52] U.S. Cl. ..... 347/2; 141/1; 409/165; 82/152

[58] Field of Search ..... 347/1, 4, 105; 101/35, 36, 38.1; 82/117, 118, 152; 142/1; 409/165; 346/139 R, 141, 139 C

[56] References Cited

U.S. PATENT DOCUMENTS

| | | | |
|---|---|---|---|
| 3,484,342 | 12/1969 | Blake | 204/18 |
| 4,029,006 | 6/1977 | Mercer | 347/2 |
| 4,201,821 | 5/1980 | Fromson et al. | 204/18.1 |
| 4,459,601 | 7/1984 | Howkins | 346/140 |
| 4,523,200 | 6/1985 | Howkins | 346/1.1 |
| 4,593,292 | 6/1986 | Lewis | 364/1.1 |
| 4,636,803 | 1/1987 | Mikalsen | 343/1.1 |
| 4,646,106 | 2/1987 | Howkins | 346/1.1 |
| 5,435,215 | 7/1995 | Thompson-Oram | 82/19 |

*Primary Examiner*—Benjamin R. Fuller
*Assistant Examiner*—Juanita Stephens
*Attorney, Agent, or Firm*—James E. Brunton

[57] ABSTRACT

A method and apparatus for imprinting high quality images on non-planar surfaces, including the surfaces of various types of three-dimensional articles, such as baseball bats, formed from a number of different types of materials. In the preferred method of the invention, the non-planar surfaces of the three-dimensional articles are printed using a uniquely modified ink jet image transfer technique. The apparatus of the invention includes a modified ink jet plotter coupled with a novel article positioning apparatus which functions to automatically maintain the surface of the article to be printed within a plan substantially parallel to and slightly spaced apart from the place within which the ink jet nozzles of the ink jet plotter reside.

21 Claims, 11 Drawing Sheets

METHODS AND APPARATUS FOR IMPRINTING INDECIA ON A THREE DIMENSIONAL ARTICLE

BACKGROUND OF THE INVENTION

1. Field of the Invention

The present invention relates generally to methods and apparatus for imprinting images on the surfaces of three-dimensional objects. More particularly, the invention concerns a novel method and apparatus for non-contact, high-quality, distortion-free printing of images on non-planar surfaces of three dimensional objects using ink jet printing technology.

2. Discussion of the Prior Art

Various types of image transfer techniques have been suggested in the past for imprinting images on a number of different material surfaces including cloth, wood, metal and ceramics. A very common technique which has been widely used is silk screening. However, such a technique is generally limited to printing on smooth, flat surfaces. Further, such a technique produce a relatively low quality print when compared to that produced by lithography, gravure, letter press sublimation and laser printing.

When the image is to be transferred to a metal surface, prior art sublimation techniques are frequently used. For example, Blake et al, U.S. Pat. No. 3,484,342 issued Dec. 16, 1969 and Fromson et al, U.S. Pat. No. 4,201,821 issued May 6, 1980 both suggest decorating unsealed and coated anodized aluminum using sublimation techniques. However, Sublimation processes also have substantial drawbacks, particularly when the surface of the object which is printed is non-planar. Transferring an image or graphic to a sphere or curved, cylindrically tapered surface by means of sublimation, is extremely difficult and such an approach, if achievable at all, would typically result in a poor quality, highly distorted image.

When printing on non-planar surfaces is required, several techniques have been suggested. For example, U.S. Pat. No. 4,741,288 issued to Stirbis et al discloses an apparatus for decorating a cylindrical can. the Stirbis et al apparatus makes use of a multiple station ink supply and a transfer apparatus for transferring ink from an ink fountain to a rotatable inking blanket wheel through a plate cylinder. The apparatus includes an ink image registration adjustment apparatus and an axial and circumferential tightness control apparatus operatively associated with each plate cylinder and each ink supply and transfer apparatus.

In addition to techniques involving the use of rotatable inking wheels such as described in Stirbis et al, other techniques which have been suggested for imprinting images on non-planar surfaces include electrophotographic imaging and magnetic imaging. As a general rule these techniques have met with limited commercial success.

Another prior art technique which is frequently used to decorate surfaces, such as anodized aluminum surfaces, involves the use of transfer films. These films typically overlay the metal surface and undesirably, are subject to film deterioration and distractive abrasion.

A very popular prior art printing technique which has found wide acceptance in recent years is ink jet printing. Within perhaps the last five years this technology has become the dominant technology for printing color images and graphics in the office and home markets. Ink jet printing basically involves a process whereby ink particles are projected in a continuous stream toward the surface to be imprinted using appropriate computer control to create text and graphics on the printing substrate. A number of different types of ink jet printers/plotters are readily commercially available from sources such as Calcomp, Packard Bell, NEC Technologies and Mutoh America, Inc.

As will be better understood from the discussion which follows, the method and apparatus of the present invention overcomes most of the prior art problems encountered in prior art attempts to print detailed images on non-planar surfaces by employing a uniquely modified prior art ink jet image transfer technique.

SUMMARY OF THE INVENTION

It is an object of the present invention to provide a method and apparatus for imprinting high quality images on non-planar surfaces, including the surfaces of various types of three-dimensional articles formed from a number of different types of materials.

Another object of the invention is to provide a method and apparatus of the aforementioned character in which the non-planar surfaces are printed using a uniquely modified ink jet image transfer technique.

Another object of the invention is to provide a method as described in the preceding paragraphs in which the image is printed on the surface of the article using a plurality of ink jet cartridges, the nozzles of which never touch the surface of the article which is being printed.

Another object of the invention is to provide an apparatus of the character described in the immediately preceding paragraph which includes a novel article positioning apparatus which functions to automatically maintain the surface of the article to be printed within a plane substantially parallel to and slightly spaced apart from the plane within which the ink jet nozzles reside.

A specific object of the invention is to provide a method and apparatus for imprinting detailed color images on the tapered cylindrical surface such as that found on the barrel and intermediate surfaces of a baseball bat.

Another object of the invention is to provide an apparatus of the class described in which the article positioning portion of the apparatus is operably coupled with a conventional type of commercially available ink jet plotter.

Another object of the invention is to provide an apparatus for imprinting high quality images on non-planar surfaces which is simple to use, is reliable in operation and requires minimum maintenance.

By way of brief summary, a major advantage of the method and apparatus of the present invention is the ability to produce high-quality, multi-colored prints on non-planar surfaces of the character not readily adapted to pass through printing machinery, including surfaces found on a number of differently configured, three-dimensional articles such as baseball bats and the like. In this regard, a particular advantage of the apparatus of the present invention is its ability to print high quality images on curved wood and metal surfaces without the dispensing nozzles of the ink jet cartridges of the apparatus coming into physical contact with the surface to be printed.

In one embodiment of the invention, the article holding and positioning apparatus of the invention is coupled with a conventional, mircoprocessor based digital plotter of the character having a plurality of ink jet cartridges which travel longitudinally of the print zone of the plotter. Typically, three ink jet cartridges contain ink of the three primary colors, namely red, yellow and blue. While a fourth cartridge contains black ink. This allows the computer program developed and stored in the computer memory to cause the application of a multiplicity of individual ink dots of various colors to the work surface so that, when combined by the human eye, appear as photoguality images. In operation of the apparatus of the invention, the article to be imprinted is typically rotated relative to the ink jet cartridges and the surface to be imprinted is continuously maintained in a plane which is parallel to and slightly spaced apart from the plane within which the ink jet nozzles reside.

In one form of the method of the invention a computer is used to communicate to the printing apparatus information containing the predetermined pattern to be printed which has either been previously scanned or originally generated using specialized software. The pattern information is typically stored in the computer memory and then sent via cable to the printing apparatus which preferably comprises a conventional plotter having four color ink jet print heads capable of dispensing pigmented inks or dyes comprised of either a solvent or water base material. A printed circuit board operably associated with the cable controllably fires the nozzles of the print heads to spray microdots of ink onto the surface to be printed in the predetermined pattern. According to one embodiment of the invention, the microdots have a diameter of approximately 0.0500 mm (0.002 inches) thereby enabling intricate images to be imprinted on the surface. Upon contact with the surface, the ink solidifies and leaves a digitally generated or scanned image or graphic on the surface without the ink jet nozzles ever coming into physical contact with the surface.

Images to be applied to irregular, non-linear surfaces as occur with changing diameters that are rotating at a constant angular rate can be printed to result in linear appearance by computer programming. The subject apparatus can also achieve the linear appearance by producing graphics that compensate dimensionally for the changing diameters and then, by scanning the graphic art work, computer data can be recorded and stored for use on the subject equipment when desired.

Computer stored images can be edited on the computer monitor screen to eliminate images, add images or erase spaces for insertion of images. Such images can be nomenclature, video camera generated photoquality images (people, objects, animals, etc.). Changes can be accomplished expeditiously just prior to printing.

Using the techniques described in the preceding paragraphs, high quality images can quickly and easily be imprinted on a variety of different types of materials and upon the non-planar surfaces of a number of types of irregularly configured three-dimensional articles.

DESCRIPTION OF THE INVENTION

Figure 1:
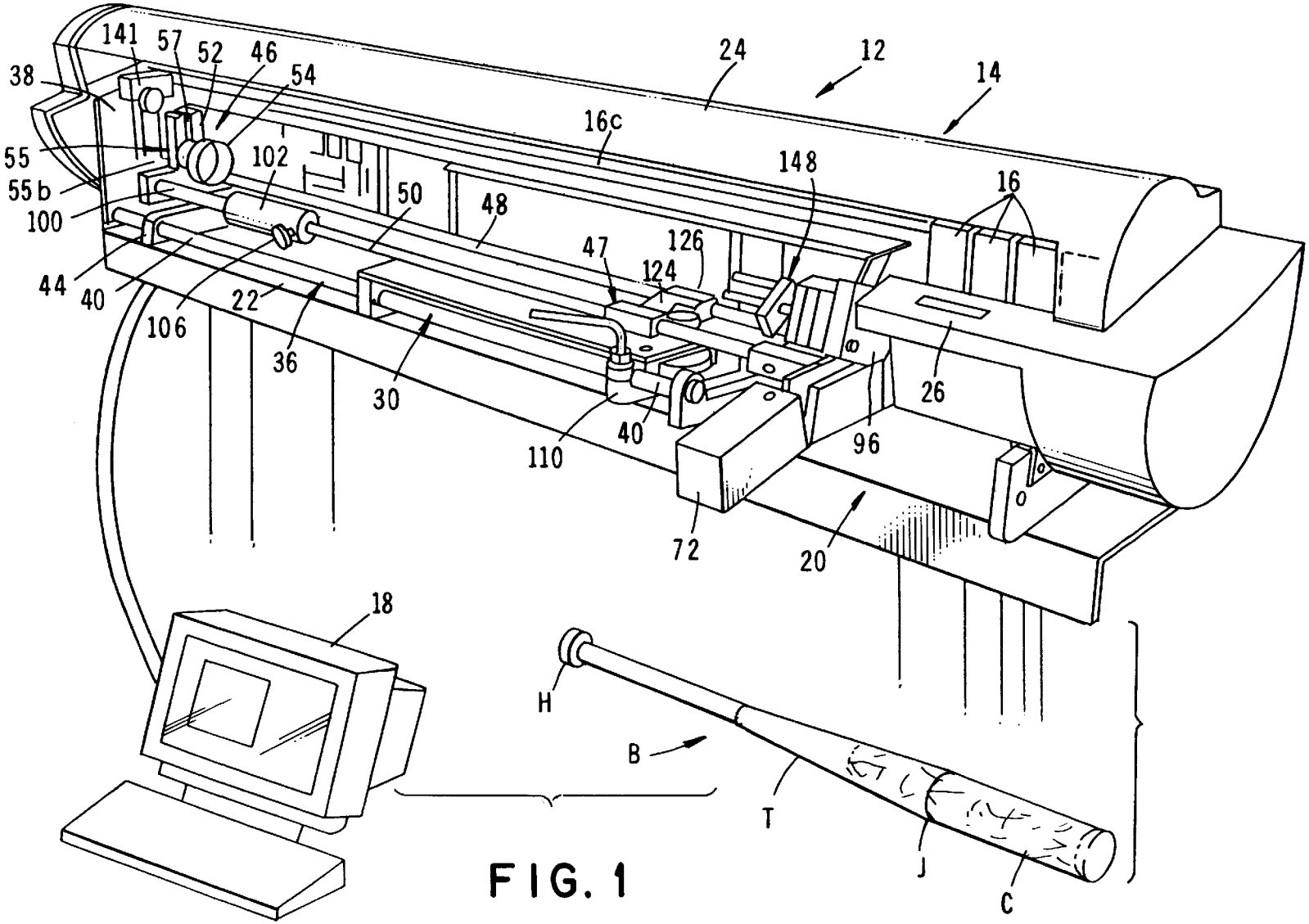
FIG. 1 is a generally perspective view of one form of the apparatus of the invention for imprinting a predetermined pattern on a surface of a three-dimensional article such as a baseball bat.
Figure 2A:
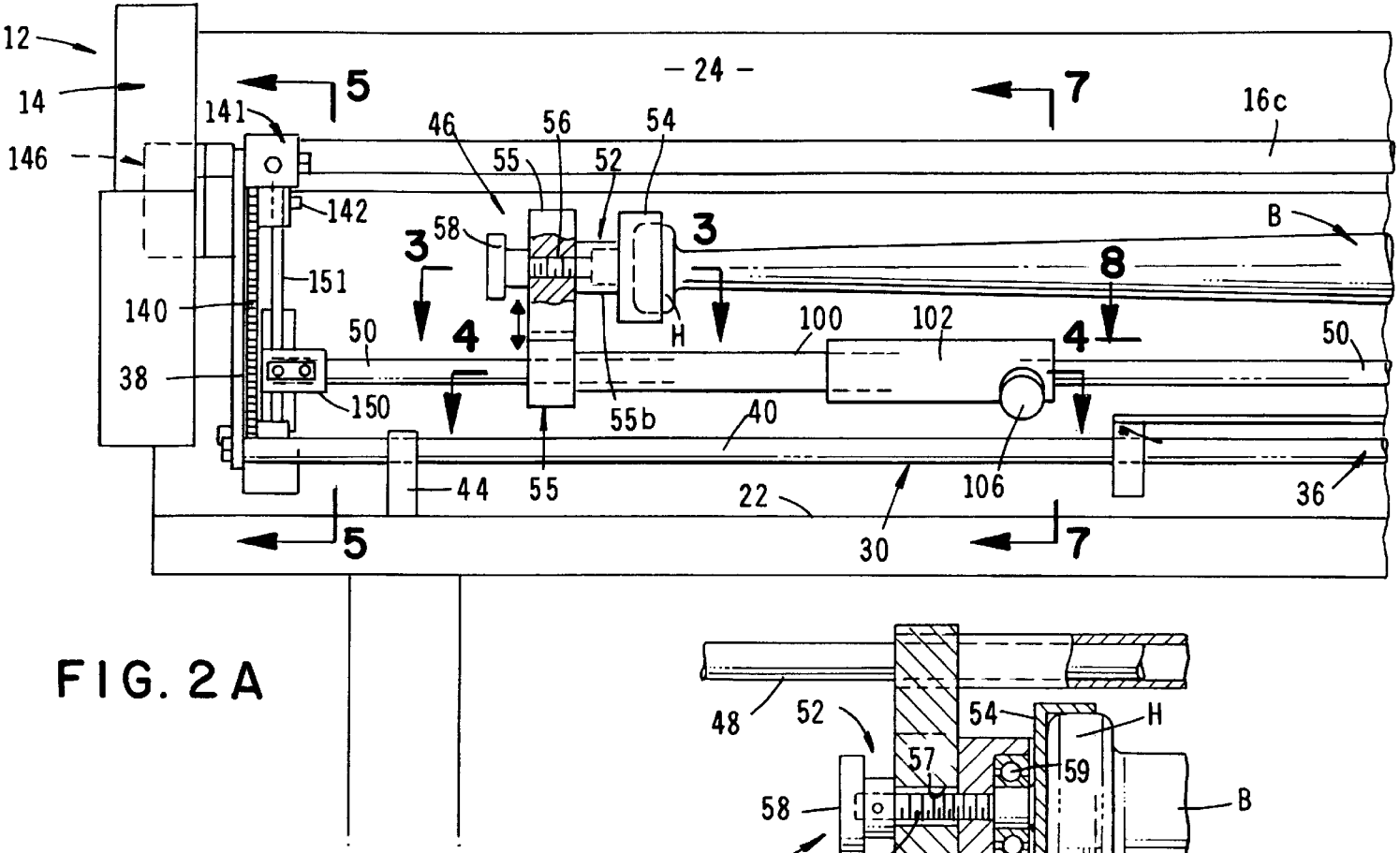
FIGS. 2A and 2B in combination comprise a fragmentary front view of the apparatus of the invention shown in FIG. 1 and illustrating the three-dimensional article positioned within the apparatus.
Figure 2B:
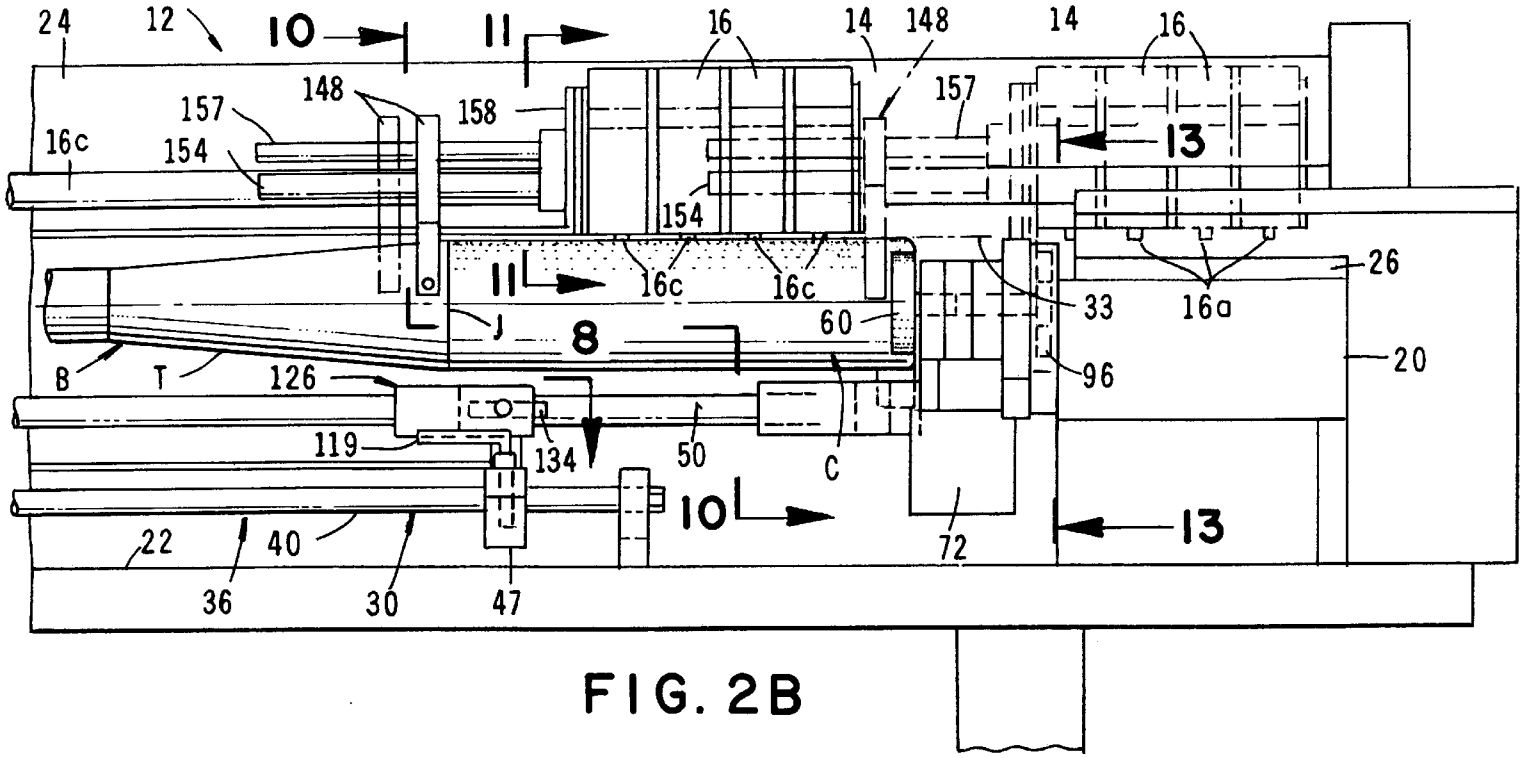

Referring to the drawings and particularly to FIGS. 1, 2A and 2B, one form of the apparatus of the invention for imprinting a predetermined pattern on a three-dimensional article is there illustrated and generally designated by the numeral 12. The apparatus of this form of the invention is made up of two main components, one being a modified, commercially available type of ink jet plotter 14 and the other comprising means for holding, positioning, and rotating the article to be imprinted within the ink jet plotter at a location proximate the color ink jet print heads 16 of the modified plotter 14 (FIG. 2B).

While various commercially available ink jet plotters can be used in connection with the positioning means of the invention, an ink jet plotter manufactured and sold by Calcomp of Anaheim, Calif. and sold under the name and style NOVAJET, Model 850 has proven satisfactory. The Calcomp 850 plotter is a 68302 microprocessor-based digital plotter which receives plotting instructions from an associated computer 18 (FIG. 1). It is also to be understood that a plotter apparatus could be specifically designed for a given application and could be used with positioning means in performing the method of the invention. Such a plotter apparatus could incorporate a moving cartridge assembly that could imprint images on a stationary object.

As best seen in FIG. 1, plotter 14 comprises a console 20 having a base 22, a covering 24 superimposed over base 22 and a control panel 26 which houses the control circuitry of the plotter. Computer 18 functions to communicate to the control circuitry of the plotter the predetermined image or graphic which is to be imprinted on the three-dimensional article. The image or graphic can be scanned or can be originally generated in the computer environment with specialized software. Typically, the computer image or graphic is stored on a hard drive and sent via a cable 26*a* to the control circuitry of the plotter 14. Techniques for scanning or originally generating the image or indicia or be imprinted on the three-dimensional article are well known to those skilled in the art.

Data transfer is controlled by the computer 18 which generates and transmits to the control circuitry of the plotter the necessary timing signals to properly sequence the processing of data and instructions to the plotter. The plotter memory typically contains the operating system to control plotter operation using the control panel.

The ink jet print heads 16, which upon command, travel longitudinally of the print zone of the plotter, are preferably of very high resolution, such as the ink jet printer sold by Calcomp of Anaheim, Calif. under the name and style TECHJET, Model 7501. Examples of the design and operation of the print head, the reservoir and the printer are more fully described in U.S. Pat. Nos. 4,593,292; 4,459,601; 4,523,200; 4,580,147; and 4,646,106. Because of the pertinency of the aforementioned patents, each of the patents is hereby incorporated by reference as though fully set forth herein.

The ink which is dispensed by the ink jet print heads can be either solvent or waterbased and is carried by the cartridges in a manner generally disclosed in U.S. Pat. Nos. 4,646,106 and 4,592,292.

In the Calcomp, Model 850 Color Ink Jet Plotter, the carriage axis is controlled by an "H" bridge driver and a servomotor. The carriage is linked by a drive belt to the motor. The carriage contains a printed circuit board which controls the firing of the nozzles in the four ink jet cartridges 16. The motor is controlled from the main printed circuit assembly by the microprocessor 18 via the control circuitry housed within control panel 26. Details concerning the construction and theory of operation of the Model 850 Color Ink Jet Plotter and details of the control circuitry thereof are readily obtainable from Calcomp of Anaheim, Calif.

Considering now the important article holding means of the invention, this means here comprises a base assembly generally designated in the drawings by the numeral 30. As best seen in FIG. 1, base assembly 30 is mounted on base 22 of the modified plotter apparatus. Minimum modification of the Model 852 plotter is required to ready it to accept the article holding, rotating and positioning means of the invention. Basically, all that is required is to remove the media drive mechanisms which manipulate the media, such as planar sheets of material, which is to be imprinted. Base assembly 30 of the holding means includes a base framework 36 having an end plate 38 and a pair of guide rods 40 and 42 which are supported by end plate 38 and by a plurality of longitudinally spaced-apart support blocks 44 which rest on base 22. Slidably mounted on guide rods 40 and 42 is a pivot means shown here as a fulcrum assembly 46 the purpose of which will presently be described.

Figure 3:
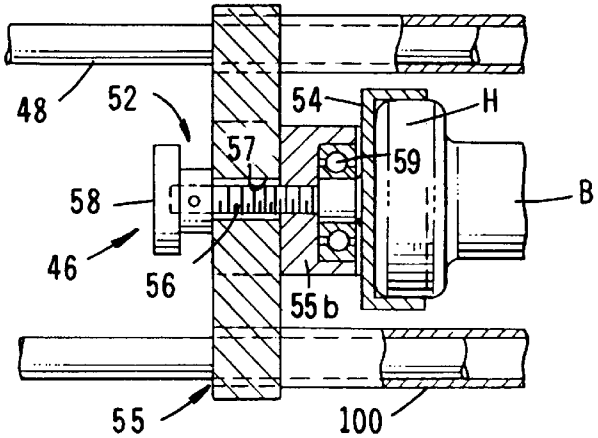
FIG. 3 is an enlarged, fragmentary, cross-sectional view taken along lines 3—3 of FIG. 2A.

Pivotally mounted on base framework 36 is an article gripping means or gripping assembly 46 which also forms a part of the article holding means of the invention. Gripping assembly 46 is mounted on base assembly 30 for pivotal movement relative to the fulcrum means of the apparatus from a first position shown in FIGS. 2A and 2B to a second position shown in FIGS. 15A and 15B. The article gripping assembly portion of the apparatus is controllably pivoted about fulcrum assembly 47 (see FIGS. 15A and 15B) by the previously mentioned article positioning means of the invention, the character of which will presently be described. As can be seen by also referring to FIG. 3, in the present form of the invention, the article gripping means comprises a pair of transversely spaced-apart guide rods 48 and 50 which support a longitudinally adjustable article receiving carriage 52.

In the form of the invention shown in the drawings, the three-dimensional article which is to be imprinted consists of a baseball bat "B" having a handle portion "H", a cylindrically shaped barrel portion "C", and a tapered intermediate portion "T" which is located between handle portion "H" and cylindrically shaped barrel portion "C". When this type of three-dimensional article is to be imprinted, carriage 52 is adapted to support handle portion "H" of the three-dimensional article in the manner shown in FIG. 3. For this purpose, carriage 52 includes a generally cup-shaped, handle-receiving member 54 which is supported by a spanner block assembly 55 which is made up of a spanner block 55*a* and a forward hub-like member 55*b*. A threaded connector 56, one end of which is connected to hub-like member 56*b* extends through a vertical slot 57 formed in spanner block 55*a*. With this construction, bats having barrel portion of various diameters can readily be accommodated by adjusting handle receiving member 54, vertically of the apparatus. This adjustment is accomplished by tightening and loosening a finger-engaging knob 58 which is connected to connector 56 to move the forward face of the knob into and out of tightening engagement with spanner block 55*a*. A conventional bearing assembly 59 is carried by block 55*b* so as to permit free rotation of cup 54 and bat "B" relative to spanner block 55 as the bat is rotated by the rotating means.

Figure 10:
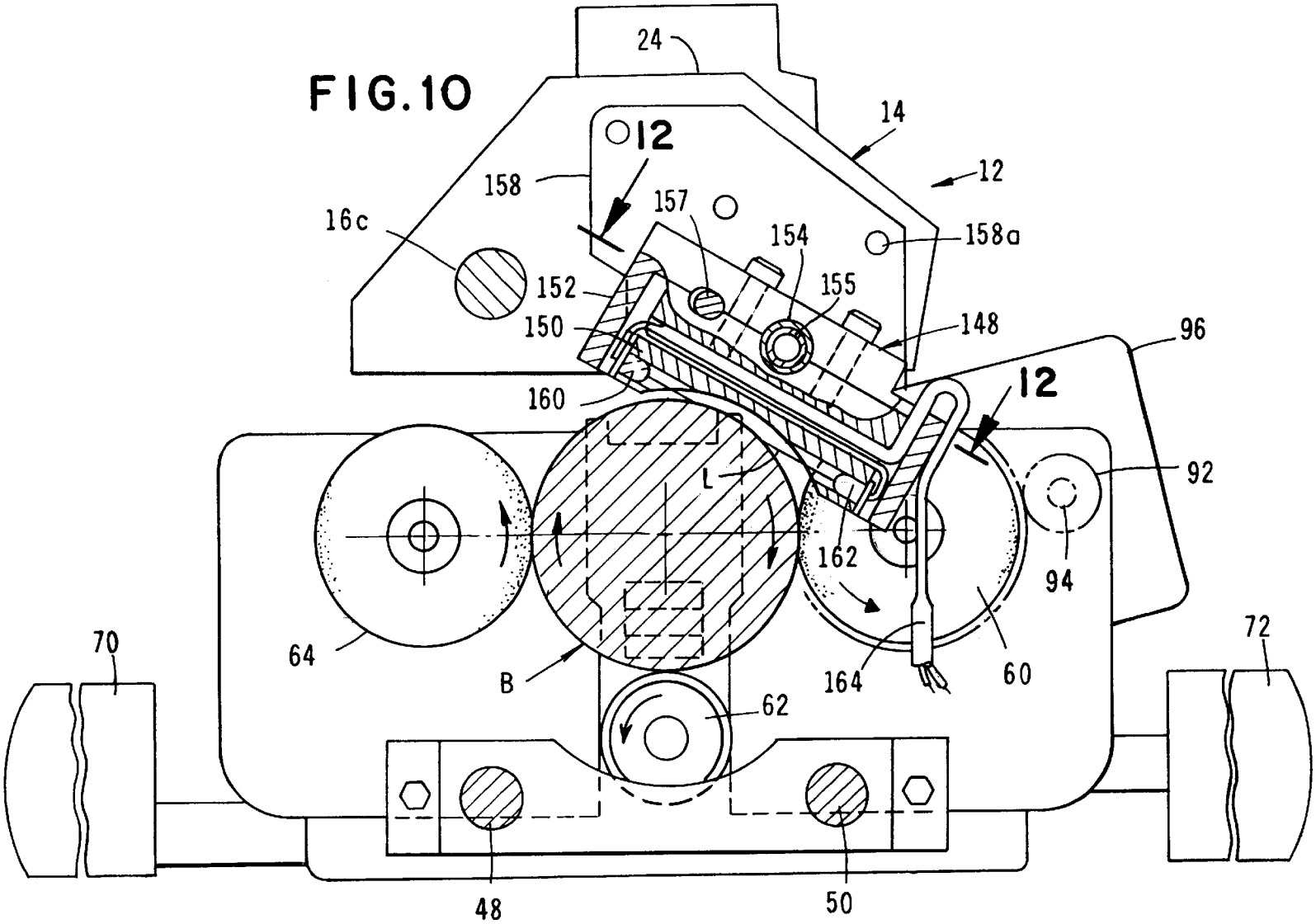
FIG. 10 is a greatly enlarged, cross-sectional view taken along lines 10—10 of FIG. 2B.
Figure 11:
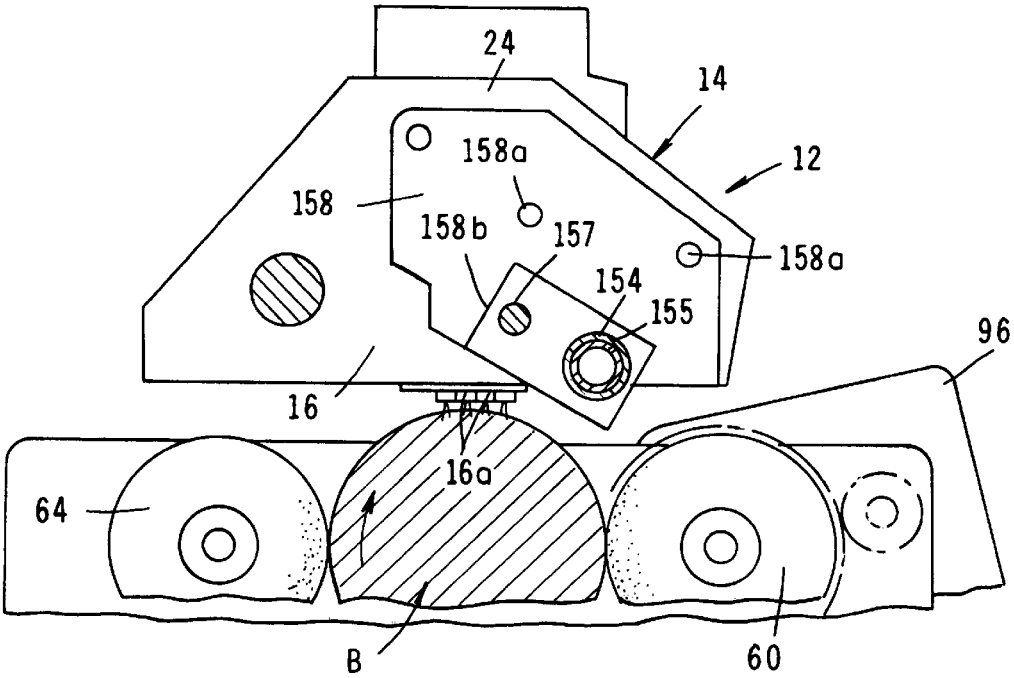
FIG. 11 is a greatly enlarged, cross-sectional view taken along lines 11—11 of FIG. 2B.
Figure 13:
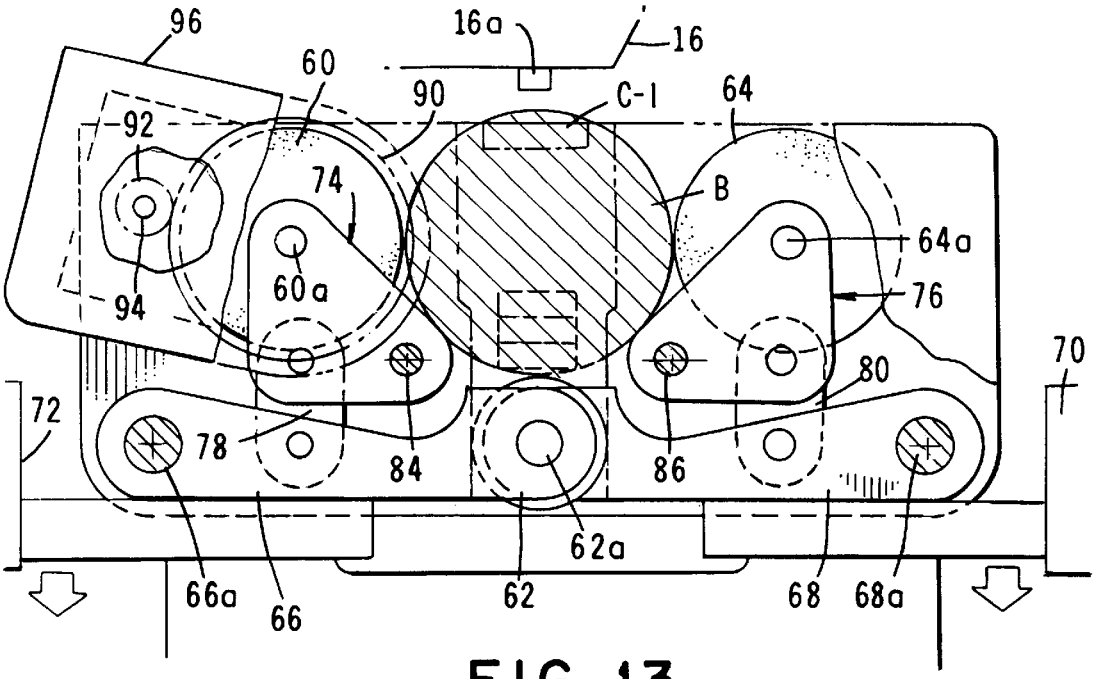
FIG. 13 is a cross-sectional view taken along lines 13—13 of FIG. 2B illustrating the manner of positioning the barrel of the baseball bat within the driving rollers of the apparatus.
Figure 14:
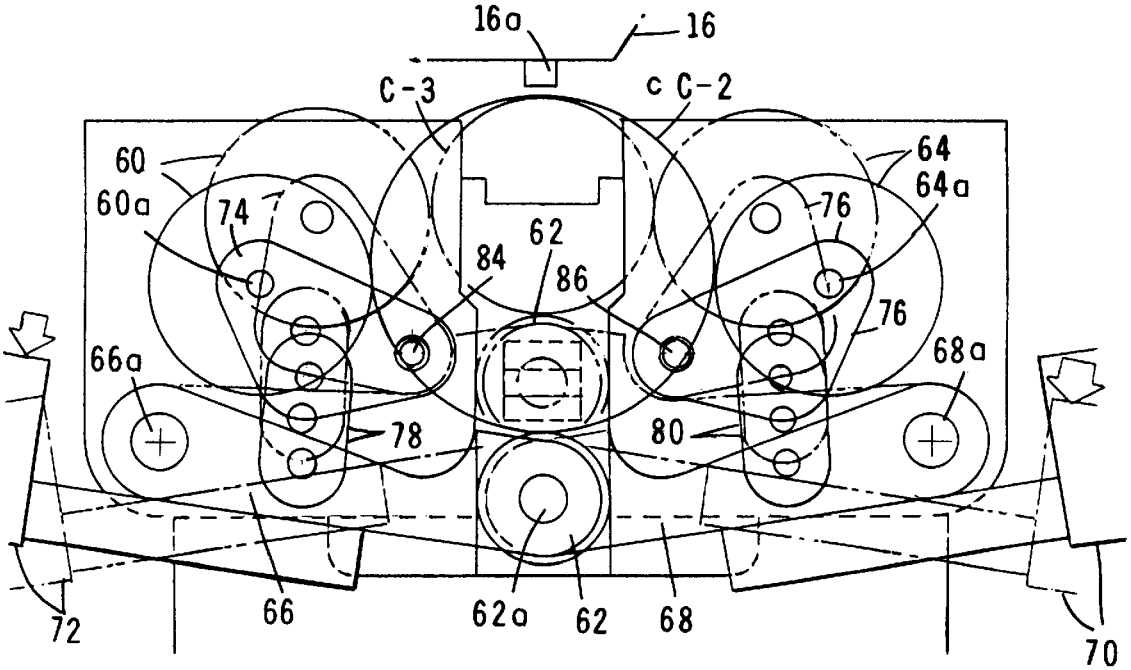
FIG. 14 is a diagrammatic view similar to FIG. 13 but showing, through the use of phantom lines, the manner in which the article holding apparatus is adjusted to accommodate bats having barrels of varying diameters.

Affixed proximate the end of guide rods 48 and 50 opposite from end plate 38, is the previously mentioned is the rotating means of the invention for controllably rotating the three-dimensional article and for strategically supporting the surfaces of article "B" which are to be printed at a location proximate nozzles 16*a* of the printing heads 16. Turning particularly to FIGS. 10, 13 and 14, this important rotating and article support means of the present form of the invention can be seen to comprise a plurality of circumferentially spaced-apart, article-engaging rollers 60, 62, and 64. Rollers 60, 62 and 64 are supported by a novel linkage assembly which, as best seen in FIG. 14, readily accommodates articles such as bats "B" which have barrel diameters of different sizes. More particularly, lower linkages 66 and 68 of the linkage assembly, which pivot about pivot shafts 66*a* and 68*a* respectively, are operably associated with counterweights 70 and 72 which continuously bias linkages 66 and 68 along with idler roller 62 from the lower position shown in FIG. 14 toward the intermediate position shown in FIG. 13. Link 66 is, in turn, interconnected with a link 74 which rotatably supports roller 60, while a link 76 which supports roller 64 is interconnected with link 68 in the manner shown in FIGS. 13 and 14. As best seen in FIG. 14, a pivotal connector link 78 interconnects links 66 and 74 while a pivotal connector link 80 connects link 68 with link 76. As indicated in FIGS. 13 and 14, links 74 and 76 are pivotally movable about pivot shafts 84 and 86 which rollers 60, 62, and 64 are rotatably supported by axles 60*a*, 62*a* and 64*a* respectively. With this construction, when a bat of intermediate size as, for example, one having a barrel portion C-1 of the diameter shown in FIG. 13 is positioned within the apparatus, weights 70 and 72 will urge rollers 60, 62 and 64 into pressural engagement with barrel portion C-1. However, when a bat of larger size having a cylindrical portion C-2 of the diameter shown in FIG. 14 is positioned within the apparatus, pivot links 66 and 68, along with idler roller 62, will be moved downwardly against the urging of counterweights 72 as shown by the solid lines in FIG. 14. Simultaneously rollers 60 and 64 will be moved radially outwardly in the manner shown by the solid lines to accommodate the enlarged diameter barrel portion C-2.

In similar fashion, as shown by the phantom lines in FIG. 14, when a bat of smaller size as, for example, one having a cylindrical portion C-3 of the diameter shown in FIG. 14, is positioned within the apparatus, weights 70 and 72 will move into the position shown by the dotted lines in FIG. 14 and in so doing, will urge roller 62 further upwardly to the position shown by the dotted lines in FIG. 14. Simultaneously, rollers 60 and 64 will be moved radially outwardly in the manner shown by the dotted lines in FIG. 14 to accommodate the barrel C-3 which is of lesser diameter than that of barrel portion C-1 and C-2. With this novel construction, bats having barrel portions of various diameters can be automatically accommodated by the apparatus and in all cases will be securely supported and positively rotated by the rotating means of the invention.

Referring particularly to FIG. 13, rollers 62 and 64 as shown in this view, are idler rollers, while roller 60 comprises a drive roller which imparts a rotational movement to the cylindrical portion C-1 of the particular bat that is positioned within the apparatus. Drive roller 60 is rotated by means of a drive member 90 which is affixed to roller 60 and, in turn, is rotated by a driver wheel 92 which is affixed to and is rotatably driven by a drive shaft 94 of motor means shown here as a motor 96. Motor 96 is a stepper motor that, in association with driver wheel 92 and drive roller 60, rotates the major diameter of the bat at the same rate that the plotter was designed to advance the paper and, therefore, the bat surface is stepping to produce the same surface speed as the paper in steps compatible with the computer program. With this construction, when motor 96 is energized, shaft 94 will rotate drive wheel 92 which, in turn, will impart rotation to drive roller 60. Driver roller 60, being in pressural contact with barrel C-1 of the bat will controllably impart uniform rotation thereto.

Figure 4:
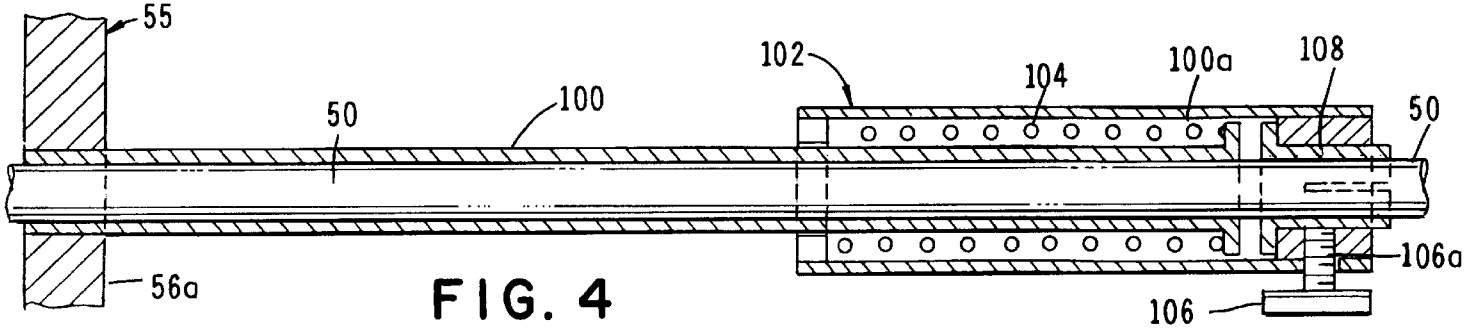
FIG. 4 is an enlarged, fragmentary, cross-sectional view taken along lines 4—4 of FIG. 2A.

In using the apparatus of the invention, the article to be imprinted, in this case baseball bat "B", is positioned within the apparatus by inserting the handle portion "H" of the bat into member 54 and then after lifting weights 72, urging the barrel portion "C" of the bat downwardly between the drive and idler rollers 60, 62, and 64 so that the barrel of the bat is correctly positioned within the apparatus in the manner shown in FIGS. 13 and 14. In addition to the ability of the apparatus to accommodate bats having barrel portions of various diameters by raising and lowering handle receiving member 54 in the manner previously described to properly position the bat within the apparatus, the apparatus can also be adjusted to accommodate bats of varying lengths. Referring particularly to FIGS. 1, 2A and 4, it is to be noted that guide rod 50 is receivable within an elongated sleeve 100 which, in turn, is telescopically receivable within a generally cylindrically shaped elongated housing 102. One end of sleeve 100 is connected to spanner block 55 and the opposite end terminates in a flange portion 100*a* which engages biasing means, shown here as a coil spring 104, which is housed within cylindrically shaped housing 102 in the manner best seen in FIG. 4. This biasing means or spring 104 functions to continuously urge spanner block 55, along with handle receiving member 54, which is attached thereto, to the right as viewed in FIG. 2A and 4, that is toward the article rotating means of the invention. With this construction small variations in the length of the bat to be imprinted can be accommodated by urging spanner member 55 to the left in the direction of the arrow of FIG. 54 and against the urging of spring 104. However, to accommodate bats having a length substantially greater than normal, spanner member 55 along with sleeve 100 and housing 102 can be slidably moved as a unit along guide rod 50. This movement is accomplished by loosening a finger engaging knob 106 which has a threaded shank 106*a,* the inboard end of which is in engagement with a second split, sleeve-like member 108 which extends into the opposite end of housing 102 from the end that receives sleeve 100. With this arrangement, when knob 106 is turned to a loosening position, the entire assembly comprising sleeve 100, housing 102, spring 104, sleeve 108 and spanner member 55 can be moved in either direction along the length of guide rod 50. When the spanner member, and its associated handle-receiving member 54, is moved into the correct longitudinal position relative to the rotating means so as to accommodate a bat of a given length, knob 106 can be tightened so as to cause sleeve 108 to securely grip guide rod 50 so as to prevent further sliding movement of the sleeve assembly.

With member 54 properly positioned both vertically and longitudinally so as to accommodate the particular bat "B" which is to be imprinted and with the barrel portion of the bat in driving engagement with the driving roller 60 of the apparatus, rotation of the bat "B" can be commenced by energizing stepping drive motor 96. As best seen by referring to FIG. 2B, as the bat "B" is rotated by the rotating means of the apparatus, the barrel portion "C" thereof is disposed in close proximity with the ink jet nozzles 16*a* of the ink jet cartridges 16.

Assuming that the pattern to be imprinted on the surface of the bat "B" has been determined and entered into the computer 18, the pattern format is first communicated to the plotter so that the control circuitry thereof will cause the correct longitudinal movement of the printing head of the plotter along the length of the print zone, which print zone is defined by the pattern data entered into the computer and transmitted to the control circuitry of the ink jet plotter 14.

Assuming that the barrel portion "C" of the bat to be imprinted is of uniform diameter and further assuming that the pattern to be imprinted on the bat extends only along the length of the uniform diameter barrel portion, printing of the pattern can be accomplished simply by controlled longitudinal movement of the print head of the plotter along the length of the barrel portion as the barrel portion of the bat is controllably rotated by the rotating means of the invention. However, in the case where the pattern to be imprinted on the bat extends beyond the uniform diameter barrel portion and onto the tapered portion "T" of the bat, the novel positioning means of the apparatus must be brought into play so as to enable uniform, distortion-free printing of the pattern continuously along both the barrel portion and the tapered portions of the bat "B".

As previously mentioned, the important positioning means of the apparatus of the invention, controllably positions the surface of the three-dimensional article, in this case the bat "B", in a manner such that the surface to be imprinted is at all times during the printing operation maintained at a substantially uniform, space-apart distance from the nozzles 16*a* of the print head 16. In the case where the tapered portion as well as the barrel portion of the bat is to be imprinted, it is apparent that the gripping means of the apparatus along with the bat "B" must be controllably pivoted about fulcrum assembly 47 in the manner shown in FIGS. 15*a* and 15*b* so as to maintain the tapered surface which resides immediately below the ink jet nozzles 16 in a plane substantially parallel to and slightly spaced apart from the plane 33 of the nozzles 16*a* (FIG. 2B).

In order to ensure correct pivotal movement of the gripping means and of the bat "B", the fulcrum assembly 47 of the invention must be adjusted longitudinally of the apparatus so that the fulcrum, which in this instance defines the pivot point, is positioned at a location that is directly below the junction "J" of the uniform diameter barrel portion of the bat "C" and the tapered portion "T" thereof (see, for example, FIG. 15*b*).

Figure 8:
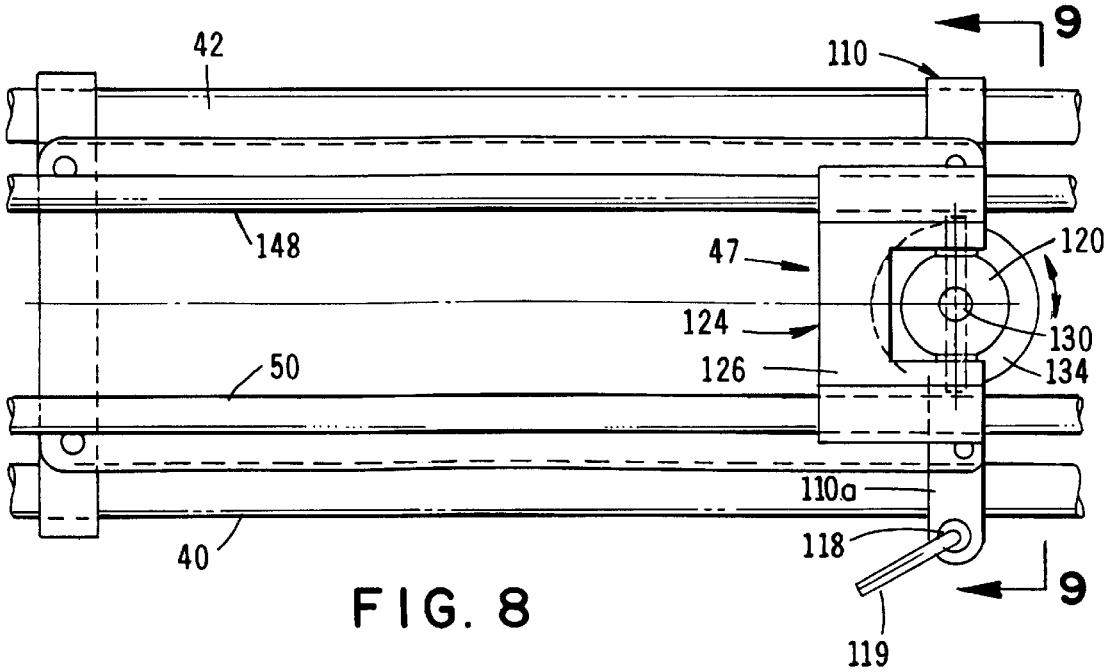
FIG. 8 is an enlarged view taken along lines 8—8 of FIGS. 2A and 2B.
Figure 9:
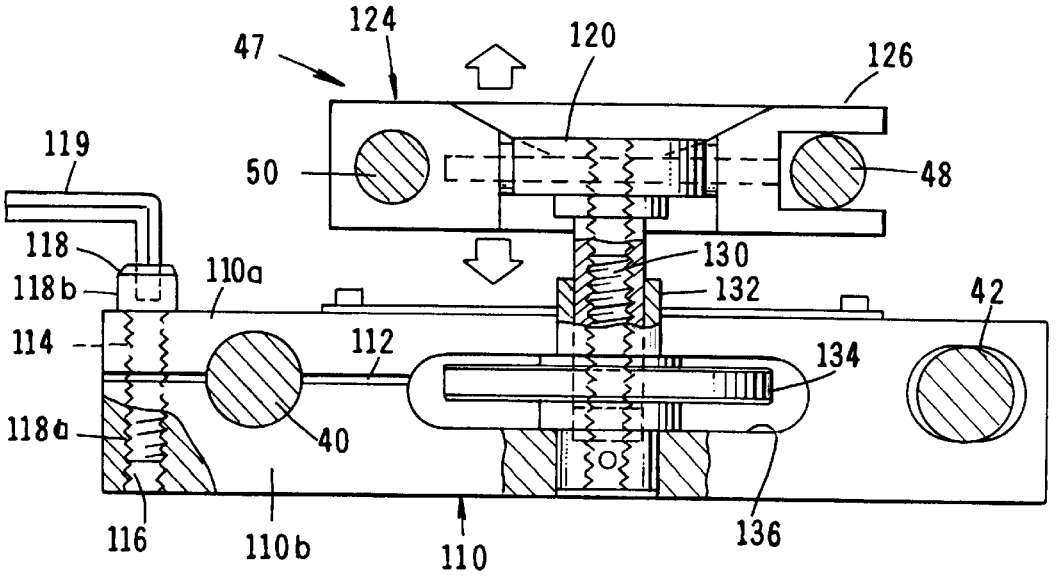
FIG. 9 is a cross-sectional view taken along lines 9—9 of FIG. 8.

Referring particularly to FIG. 9, it is to be observed that the pivot means or fulcrum assembly of the present form of the invention comprises a spanner base member 110 which, in the manner shown in FIG. 8, spans and is slidably connected to guide rods 40 and 42 of base assembly 30. Disposed on either side of a transversely extending slot 112 formed in spanner base member 110 are slightly spaced apart upper and lower portions 110*a* and 110*b* thereof respectively. Extending through internally threaded bores 114 and 116 provided in portions 110*a* and 110*b* is a threaded connector 118 which has a threaded shank portion 118*a* and a head portion 118*b*. Receivable within head portion 118*b* is a handle 120 which can be used to rotate threaded member 118 in a manner to selectively tighten or loosen portions 110*a* and 110*b* of the spanner base relative to guide rod 42. With this arrangement, by loosening connector 118, spanner base 110 can be freely moved longitudinally of the guide rods 40 and 42 in a manner to precisely position the fulcrum plate 124 directly beneath the junction "J" of the barrel and taper portions "C" and "T" of the particular bat which is to be imprinted. When the assemblage is in the correct location, handle 120 is tightened to lock the assemblage against sliding movement along the guide rods.

Also forming a part of the fulcrum means of the invention, is a spanner plate 126 which spans and is slidably interconnected with guide rods 48 and 50 of the article gripping assembly of the apparatus. As indicated in FIG. 9, fulcrum plate 120 is connected to a threaded shaft 130 and is vertically adjustable relative to member 126 in the manner indicated by the arrows of FIG. 9. As indicated in FIG. 9, threaded shaft 130 is threadably interconnected with an internally threaded collar 132 which is, in turn, connected to spanner base member 110. A thumb wheel 134, which is partially receivable within a chamber 136 formed in spanner member 110, is accessible in the manner indicated in FIG. 8 so that rotational movement can be imparted to the thumb wheel 134. Imparting of such rotational movement to the thumb wheel will cause rotation of threaded shaft 130 which, in turn, will raise or lower support plate 120 relative to plate 126 and to rods 48 and 50.

With the fulcrum assembly properly adjusted both vertically and longitudinally in the manner described in the preceding paragraph, the positioning means comes into play to properly maintain the surface to be imprinted in a correct printing relationship with respect to the ink jet printing nozzles 16*a*. In the present form of the invention, the important article positioning means comprises elevating means associated with the article gripping assembly for controllably elevating the handle portion of the bat "B" and sensor means operably associated with the elevating means to appropriately actuate the elevating means when the printing heads of the ink jet plotter reach the junction "J" between the barrel portion "C" and the tapered portion "T" of the bat being imprinted.

Figure 5:
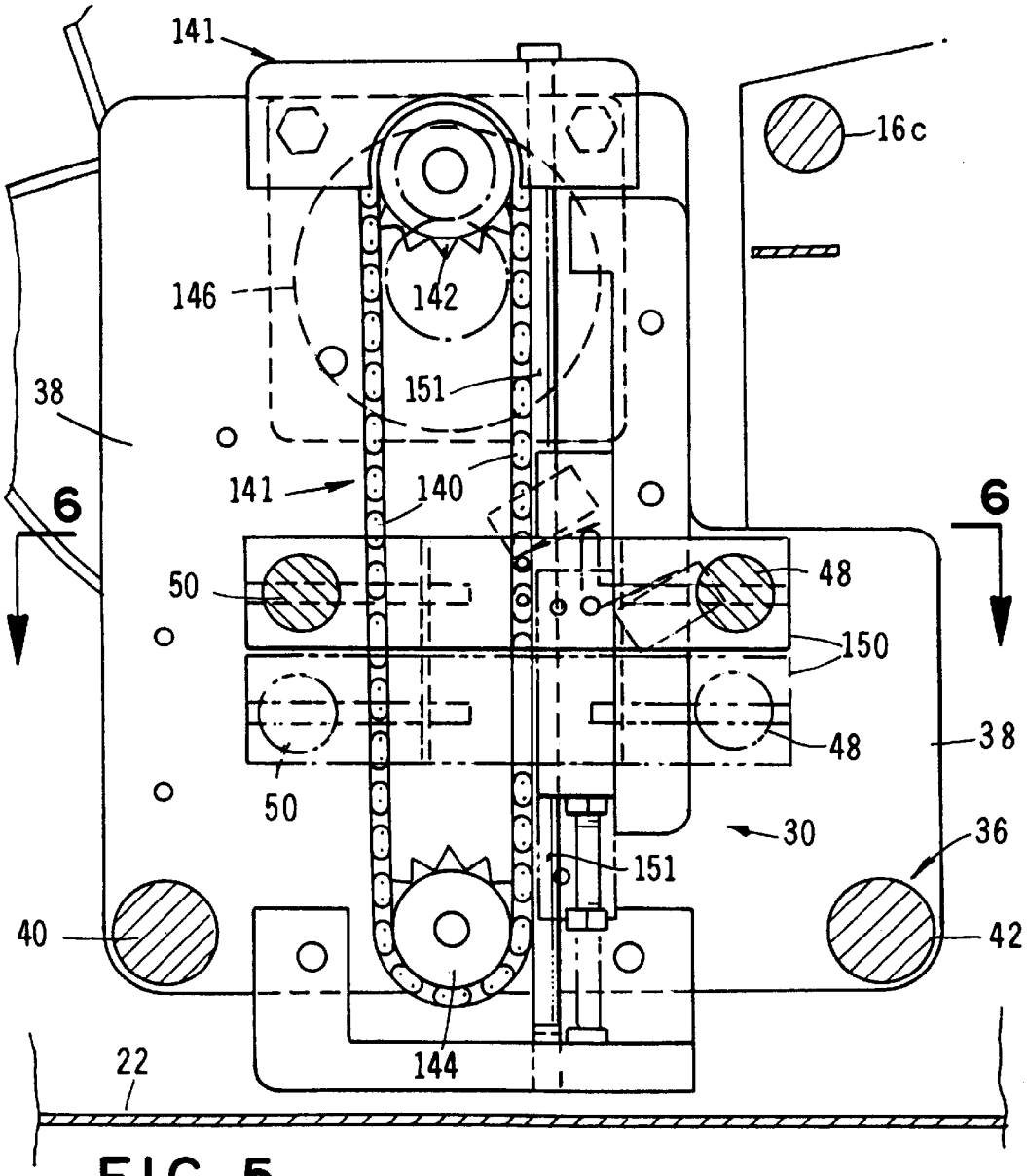
FIG. 5 is a greatly enlarged, crbss-sectional view taken along lines 5—5 of FIG. 2A.
Figure 6:
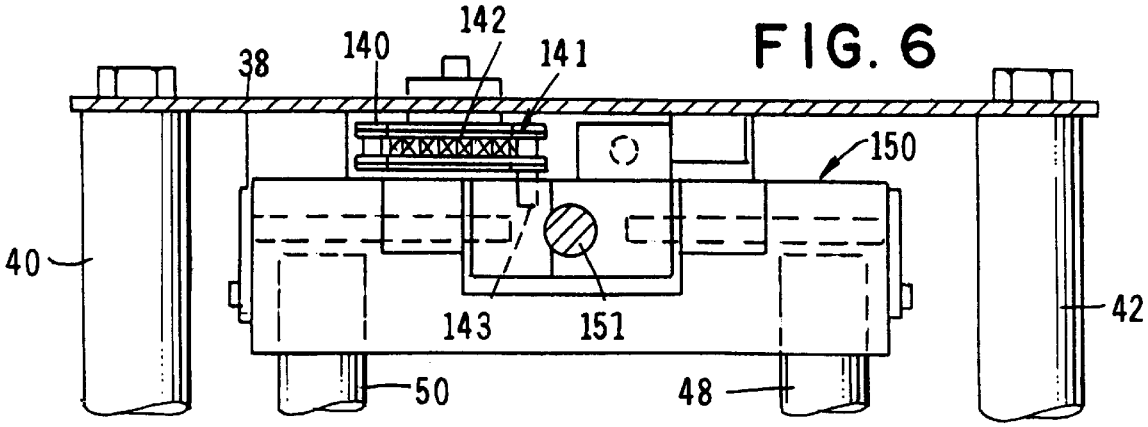
FIG. 6 is a cross-sectional view taken along lines 6—6 of FIG. 5.
Figure 7:
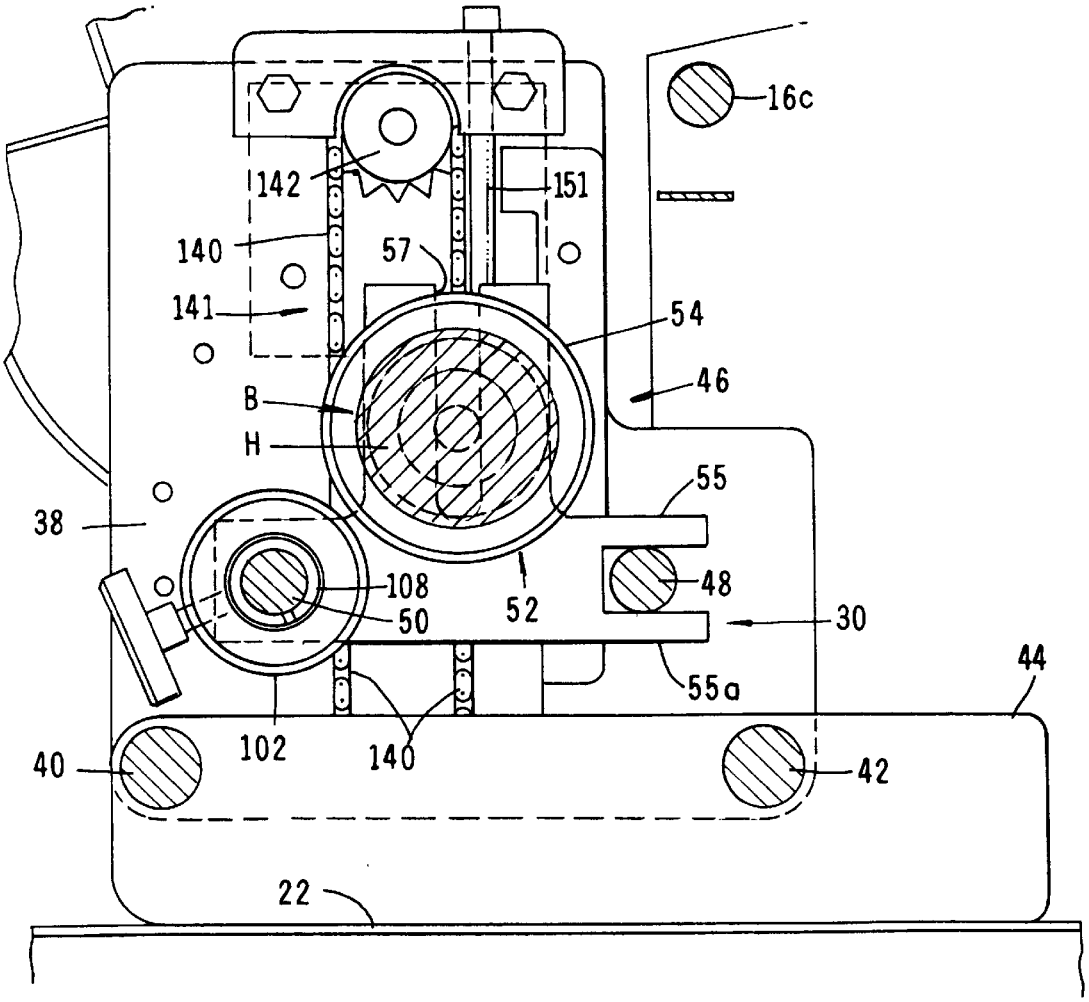
FIG. 7 is a greatly enlarged, cross-sectional view taken along lines 7—7 of FIG. 2A.

Referring particular to FIGS. 5 and 6, the elevating means of the present form of the invention comprises a chain drive assembly 141 which includes an elongated chain 140 that is appropriately entrained about upper and lower sprocket wheels 142 and 144 respectively. As best seen in FIGS. 2A and 6, chain drive assembly 141 is mounted on end plate 38 as is the motor means which functions to controllably rotate upper sprocket 142. The motor means here comprises an electric motor 146 which is mounted on end plate 38 and is drivably connected to upper sprocket 142. As shown in FIGS. 5 and 6, chain 140 is connected by a connector pin 143 to a spanner member 150 which is interconnected to and spans guide rods 48 and 50 in the manner shown in FIG. 5. When motor 146 is energized in the manner presently to be described to rotate sprocket wheel 142, chain 140 will be driven about the sprocket wheels in a manner to slide spanner member 150 upwardly along a vertical guide rod 151 from the position shown in the phantom lines in FIG. 5 to the position shown in the solid lines in FIG. 5. This lifting movement causes one end of the gripping assembly of the apparatus, along with the handle "H" of the bat, to move pivotally from the position shown in FIGS. 2A and 2B to the position shown in FIGS. 15A and 15B. This, in turn, causes the surface of the tapered portion "T" of the bat to move toward the plane of the ink jet nozzles 16*a*. The chain and sprocket assembly shown in FIG. 5 is of a character well known to those skilled in the art and can be assembled from readily commercially available components.

In operating the apparatus, selective energization of the drive motor 146 is accomplished by the unique sensor means of the invention which functions to sense a change in the spacing between the surface of the three-dimensional article being imprinted and the plane 33 within which the nozzles 16*a* of the print heads reside. As will presently to be described, the sensor means here includes means for generating and transmitting an appropriate signal to motor 146 which reflects a change in spacing between the surface of the three-dimensional article to be imprinted and the plane 33 in which the ink jet nozzles reside.

Figure 12:
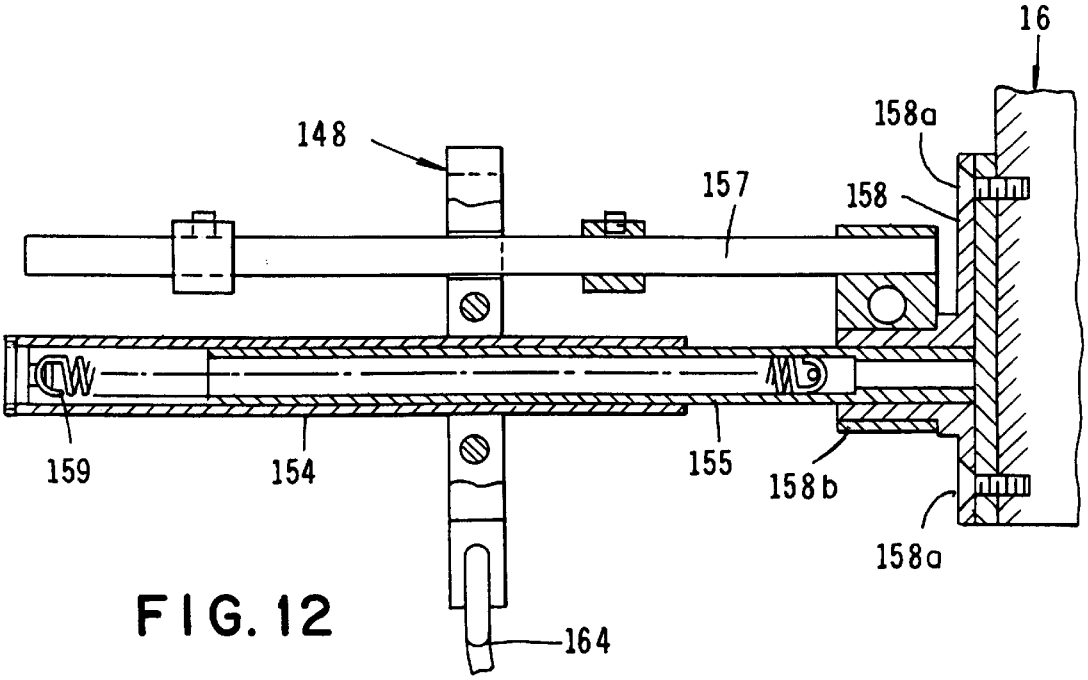
FIG. 12 is an enlarged, cross-sectional view taken along lines 12—12 of FIG. 10.
Figures 15A, 17:
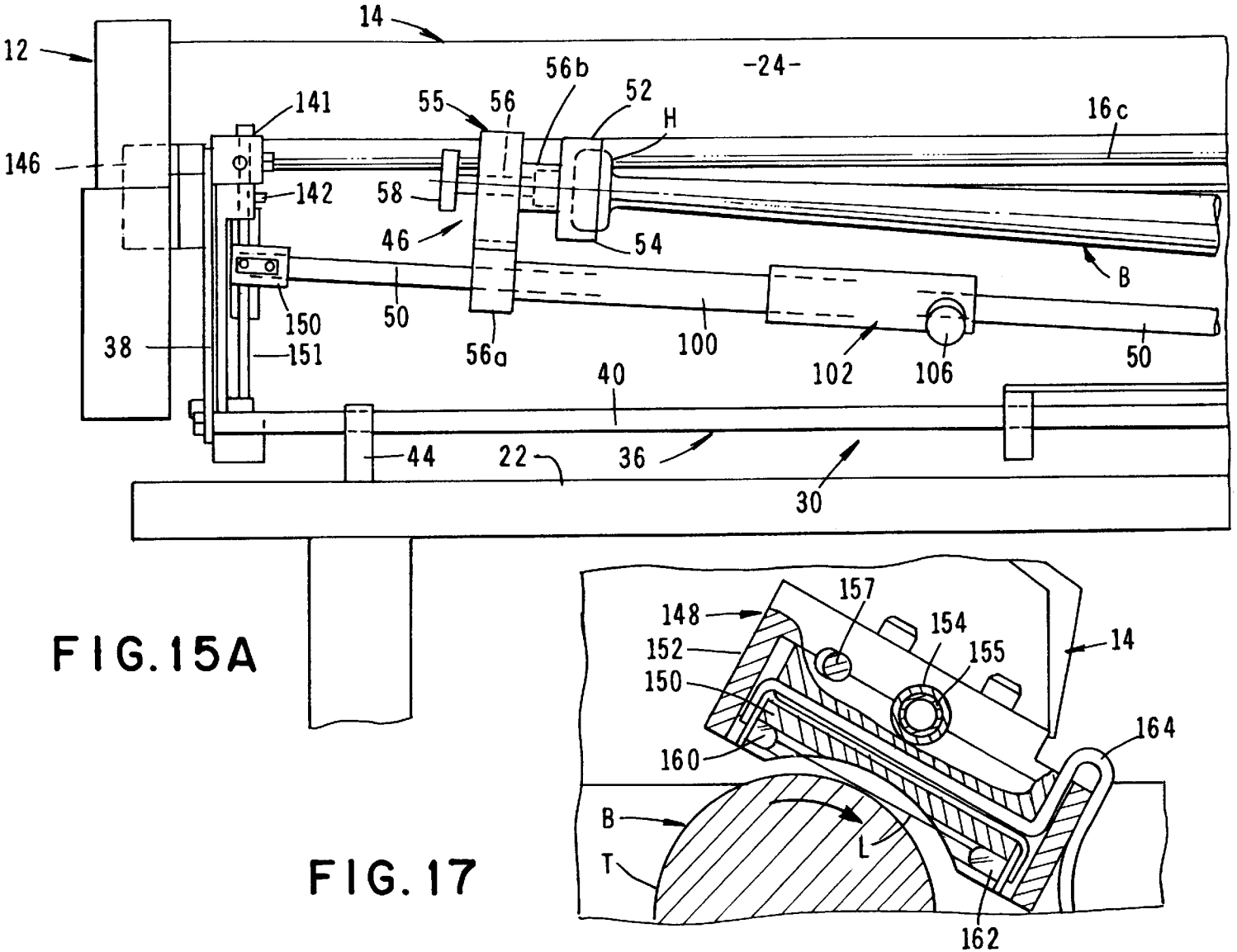
FIGS. 15A and 15B are similar to FIGS. 2A and 2B and in combination show the manner in which the article to be imprinted, in this case the baseball bat, is elevated with respect to the plane of the dispensing nozzles of the print cartridges as the print cartridges travel longitudinally of the print zone.
FIG. 17 is a cross-sectional view similar to FIG. 16, but showing the position of the baseball bat barrel relative to the sensor apparatus such that the infrared beam of the sensor apparatus is unbroken by the barrel of the baseball bat.
Figure 15B:
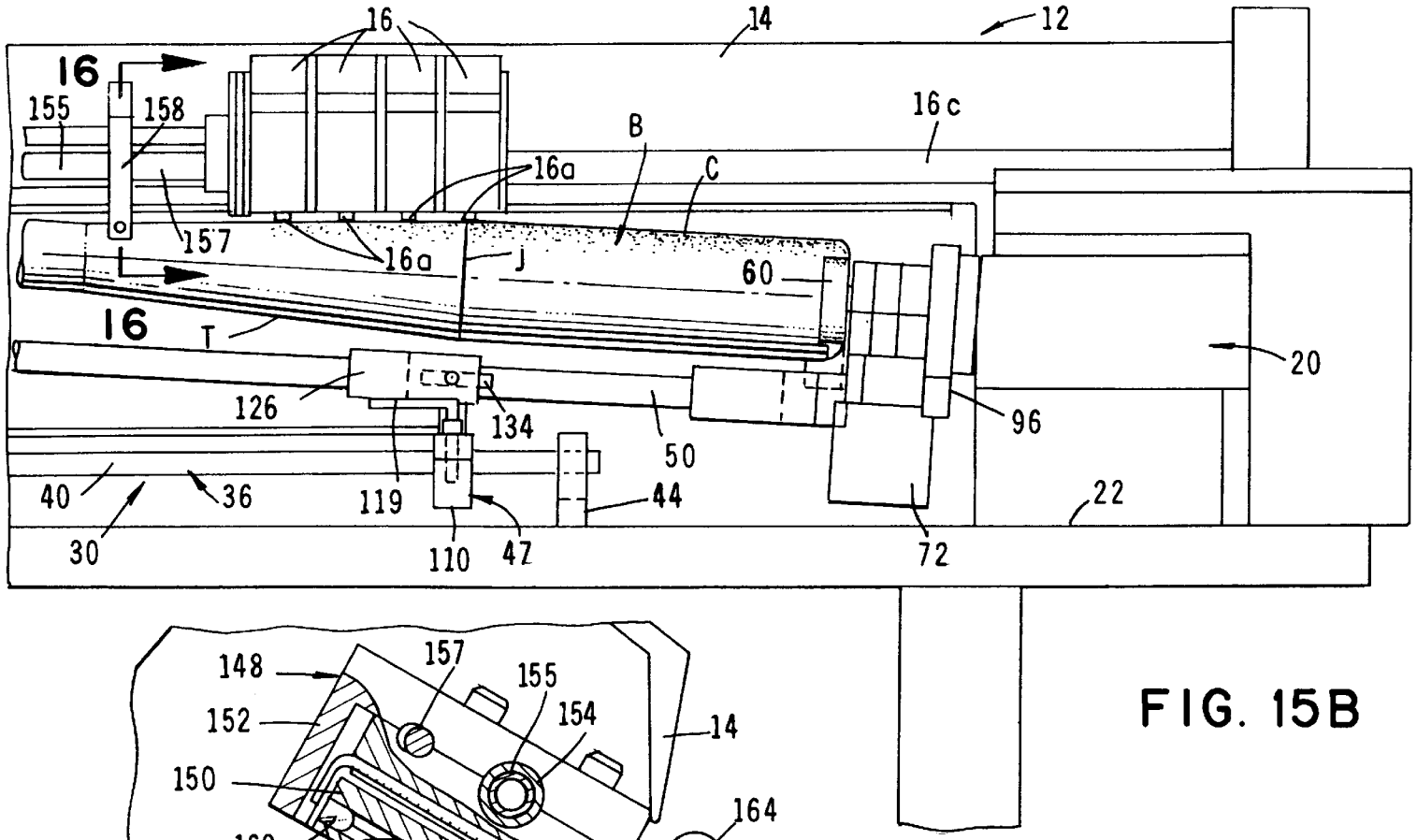
Figure 16:
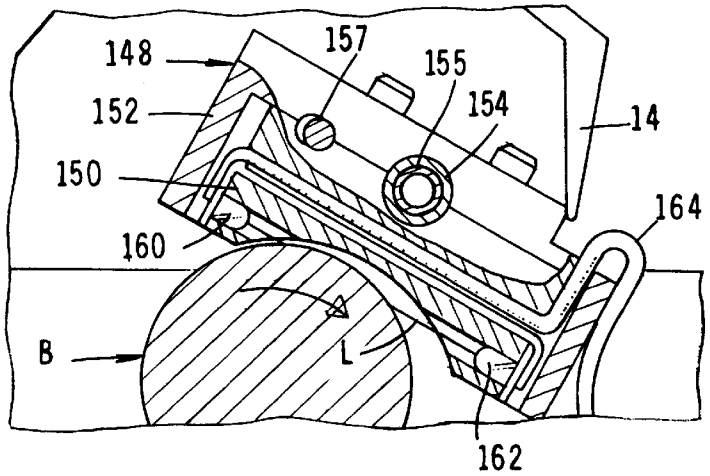
FIG. 16 is a greatly enlarged, cross-sectional view taken along lines 16—16 of FIG. 15B.

Referring particularly to FIGS. 10, 16 and 17, the novel construction of the sensor means of the present invention is there illustrated. Here the sensor means comprises an infrared sensor 148 having sensor body 150 to which a sensor wiring cover 152 is interconnected in the manner best seen in FIG. 10. A sleeve 154 which receives support rod 155 extends through the sensor 148 in the manner shown in FIG. 12 and functions to connect the sensor to one of the ink jet print heads 16 of the apparatus in the manner shown in FIG. 12. The sensor assembly 148 also slidably accepts a guide rod 157 which guides travel of the sensor assembly along sleeve 155. With this construction, it is apparent that sensor assembly 148 and sleeves 154 and 155 will travel along with the ink jet plotter print heads 16 as the print heads move longitudinally of the print zone of the apparatus. As best seen in FIG. 12, sleeve 155 is connected to a connector plate 158 which is, in turn, connected to print head 16 by appropriate fasteners 158*a*. Plate 158 includes a hub portion 158*b* within which sleeve 155 is received. A spring 159, which is housed within sleeves 154 and 155 urges sleeve 154, along with sensor 148 toward print head 16 along a longitudinally extending plotter guide rod 16*c*.

Figure 18:
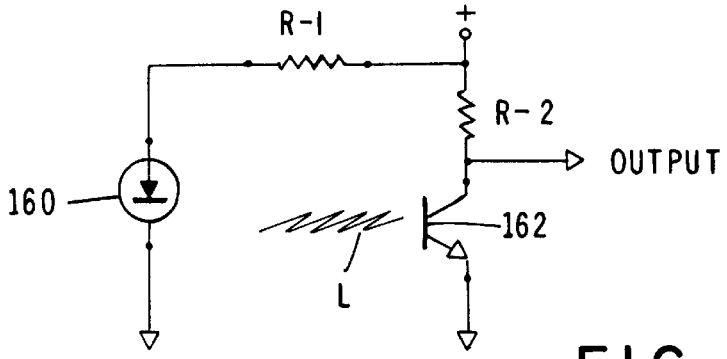
FIG. 18 is a generally schematic view of one form of the control circuitry of the apparatus of the invention.

With respect to the sensor assembly 148, affixed to one end of body 150 is an infrared light emitting diode (LED) 160 and affixed proximate the opposite end of body 150 is a infrared photo detector 162 which functions to detect the beam of light "L" transmitted from the infrared LED. A cable 164 interconnects the sensor with the control circuit of the apparatus which, in turn, is operably interconnected with drive motor 146 of the elevating means of the invention. It is to be noted that the sensor assembly 148 is strategically positioned relative to the bat "B" so that so long as the sensor travels along the uniform diameter of the barrel portion of the bat, the infrared light beam "L" will be interrupted by the barrel of the bat (FIG. 10). When the sensor beam is thus interrupted, the sensor output is high (approximately 11.5 volts DC) (see FIG. 18) and the control circuit commands motor 146 of the elevating means to drive member 150 in a downwardly direction and into the position shown by the phantom lines in FIG. 5. A limit switch is provided within the circuitry of the apparatus which automatically stops the motor in the full down position shown by the phantom lines in FIG. 5. However, when the sensor reaches the reduced diameter tapered portion "T" of the bat as shown in FIG. 17, the infrared beam "L" will no longer be interrupted by the bat and the light beam will be sensed by the infrared photo detector 162. When this occurs, the control circuit of the apparatus commands motor 146 of the elevating means to drive member 150 toward the upward position shown by the solid lines in FIG. 5. As indicated in FIG. 16, as plate 150 is elevated along with the handle portion of the bat, the tapered surface will be moved into the plane of the ink jet print heads 16*a* causing the infrared beam to, once again, be interrupted (see FIG. 16). This interruption of the light beam "L" will terminate the "up" command thereby de-energizing the motor 146. In a manner well understood by those skilled in the art, a dead band between the high and low sensor output signals is designed into the control circuit to provide an adjustable region where the "up" and "down" commands are discontinued to prevent oscillation. A limit switch is also provided to limit the "up" motion. In this regard reference should be made to FIG. 18 wherein the output is "high" (approximately 11.5 volts DC) when the infrared beam is interrupted. Similarly, the output is "low" (approximately 1.5 volts DC) when the infrared beam is open. Circuit 18 which includes resistors R1 and R2 is of a conventional construction well known to those skilled in the art.

With the novel construction described in the preceding paragraphs, as the print heads 16 of the ink jet plotter and the sensor 148 move along the uniform diameter barrel portion "C" of the bat, the infrared beam "L" is interrupted and the driving motor of the elevating means will not be energized. However, when the sensor reaches the junction between the tapered portion and the barrel portion of the bat, the sensor will immediately sense the change in distance between the plane of the surface to be imprinted and the plane of the ink jet nozzles because the beam "L" will no longer be interrupted (See FIG. 17). Once this occurs, the motor means of the elevating means, namely motor 146, will be appropriately energized to elevate the gripping means along with the handle portion and tapered portion of the bat into the position shown in FIG. 15B so that the tapered surface of the bat, which is to be imprinted, will continuously reside in a second plane parallel to and slightly spaced apart from the plane of the ink jet nozzle 16*a*. In this way the pattern to be printed will remain free from distortion and will continue uniformly from the enlarged diameter barrel portion of the bat onto the tapered portion "T" of the bat. Sensor 148 and the control circuitry associated therewith for controllably energizing the motor 146 of the elevating means is of a character well known to those skilled in the art and need not be described herein in greater detail.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In combination with a microprocessor-based digital plotter that produces copies of computer data based on plotting instructions received from a host computer, said plotter being of a character having a print zone having a length and a carriage which carries at least one ink jet cartridge for movement along the length of the print zone of the plotter and means for controlling firing of the nozzle of the ink jet cartridge, an improvement comprising article-holding means for holding within the digital plotter a three-dimensional article having a curved surface upon which the computer data is being imprinted, said improvement further comprising:

(a) rotating means for controllably rotating the three-dimensional article relative to the ink jet cartridge; and (b) positioning means for controllably positioning the surface of the three-dimensional article said three dimensional article being disposed proximate the nozzle of the ink jet cartridge wherein the positioning means maintain the surface of said article at all times at a substantially uniform spaced-apart distance from the nozzle.

2. The combination as defined in claim 1 in which the plotter includes a plurality of ink jet cartridges each having a nozzle disposed in a first plane and in which said positioning means includes elevating means for controllably elevating the three-dimensional article relative to the ink jet cartridges to continuously maintain the surface of the article proximate said nozzle of each said ink jet cartridge in a second plane which is spaced apart from and substantially parallel to said first plane.

3. The combination as defined in claim 2 in which the three-dimensional article includes a tapered cylindrical surface and in which said elevating means controllably elevates the tapered surface of the article relative to the first plane so as to continuously maintain the tapered surface proximate each ink jet nozzle within the second plane.

4. The combination as defined in claim 3 in which the article holding means comprises a base assembly and an article gripping assembly pivotally mounted on said base assembly for pivotal movement by said elevating means between first and second positions.

5. The combination as defined in claim 4 in which said base assembly comprises a fulcrum assembly and in which said elevating means comprises motor means connected to said base assembly for controllably pivoting said article gripping assembly relative to said fulcrum.

6. The combination as defined in claim 5 in which said fulcrum assembly is slidably movable relative to said base assembly between first and second positions.

7. An apparatus for imprinting a predetermined pattern on a curved surface of a three-dimensional article, comprising:

(a) an ink jet cartridge having a dispensing nozzle for dispensing ink, said nozzle being disposed in a first plane;

(b) means for moving said ink jet cartridge relative to the surface of the three-dimensional article;

(c) means coupled with said ink jet cartridge for receiving information containing the predetermined pattern, said receiving means controlling the dispensing of ink from said nozzle in response to said received information;

(d) rotating means for rotating the three-dimensional article relative to said dispensing nozzle; and (e) positioning means for controllably positioning the three-dimensional article relative to said dispensing nozzle to continuously maintain the surface being imprinted within a second plane proximate to and substantially parallel with said first plane.

8. An apparatus as defined in claim 7 in which the surface being imprinted comprises a tapered cylindrical surface and in which said positioning means comprises elevating means for elevating the tapered cylindrical surface relative to said first plane as the three-dimensional article is being rotated.

9. An apparatus as defined in claim 8 in which the three-dimensional article being imprinted comprises a baseball bat having a barrel portion, a handle portion, and an intermediate tapered portion and further including gripping means for gripping the handle and the barrel portions of the baseball bat.

10. An apparatus as defined in claim 9 in which said means for receiving information comprises a microprocessor.

11. An apparatus as defined in claim 9 further including a plurality of ink jet cartridges each having an ink dispensing nozzle disposed within said first plane.

12. An apparatus as defined in claim 9 in which said elevating means includes sensor means for sensing the position of the curved and tapered surfaces of the baseball bat as said ink jet nozzle moves relative to the three-dimensional article and for generating and communicating information with respect thereto.

13. An apparatus as defined in claim 12 in which said elevating means comprises motor means operably connected to said sensor means for elevating the tapered cylindrical surface of the baseball bat relative to said first plane in response to information generated by said sensor means.

14. An apparatus for imprinting a predetermined pattern on a curved surface of a three-dimensional article, comprising:

(a) a plurality of ink jet cartridges each having a dispensing nozzle for dispensing ink, each said nozzle being disposed in a first plane;

(b) moving means for moving said plurality of ink jet cartridges relative to the surface of the three-dimensional article;

(c) means coupled with said ink jet cartridges for receiving information containing the predetermined pattern, said receiving means controlling the dispensing of ink from each said nozzle in response to said received information;

(d) rotating means for rotating the three-dimensional article relative to each said dispensing nozzle; and (e) article positioning means for positioning the surface of the three-dimensional article in a spaced location relative to said first plane, said article positioning means comprising sensor means for sensing a change in said spaced location between the surface of the three-dimensional article and said first plane, said sensor means including means for generating and transmitting a signal reflecting said change.

15. An apparatus as defined in claim 14 in which the three-dimensional article has a handle portion and a barrel portion transitioning to a tapered portion disposed intermediate said barrel portion, and further including gripping means for gripping said handle portion and said barrel portion of said three-dimensional article.

16. An apparatus as defined in claim 15 in which said sensor means comprises a photosensor for directing a beam of light along a path which intersects the barrel portion of the three-dimensional article and includes means for generating a first signal when said beam no longer intersects the barrel position.

17. An apparatus as defined in claim 15 in which said article positioning means further comprises elevating means for elevating the three-dimensional article in response to said first signal transmitted by said sensor means so as to move the surface thereof which is being imprinted into a second plane spaced apart from and substantially parallel with said first plane.

18. An apparatus as defined in claim 17 in which said elevating means comprises motor means for elevating the tapered portion relative to said first plane, said motor means being energized in response to said first signal generated by said sensor means.

19. A method for imprinting indicia on a non-planar surface of a three-dimensional article using a digital plotter having a printing zone, a carriage which carries at least one ink jet cartridge having a nozzle along the printing zone, means for controllably firing of the nozzle of the ink jet cartridge and an article positioning means carried by the digital plotter for positioning the surface of the three-dimensional article upon which the indicia is being imprinted relative to the nozzle of the ink jet cartridge, the method comprising the steps of:

(a) controllably rotating the three-dimensional article relative to the printing zone;

(b) controllably moving the surface of the three-dimensional article relative to the printing zone to maintain the surface at a substantially uniform spaced-apart distance from the nozzle of the ink jet cartridge; and (c) firing the nozzle to selectively deposit microdots of ink on the surface of the article as the article moves relative to the printing zone.

20. A method as defined in claim 19 in which the digital plotter includes a plurality of ink jet cartridges each having a nozzle disposed in a first plane the method including the step of moving the surface of the three-dimensional article relative to the ink jet cartridges to continuously maintain the surface of the article in a second plane which is spaced apart from and substantially parallel to said first plane.

21. A method as defined in claim 19 in which the three-dimensional article includes a tapered cylindrical surface and in which the method includes the step of controllably elevating the tapered surface of the three-dimensional article relative to the first plane so as to continuously maintain the tapered surface proximate the nozzle of the ink jet cartridges within a second plane.

* * * * *